US005445186A

United States Patent [19]

Richter et al.

[11] Patent Number: 5,445,186

[45] Date of Patent: Aug. 29, 1995

[54] BACK-FLOW PREVENTING BAG VALVE FOR BAG-IN-BOX CONTAINER

[75] Inventors: Simon J. Richter, Blairsville, Ga.; Kevin J. Totten, South Elgin, Ill.; William S. Credle, Jr., Stone Mountain; Thomas R. Boston, Fairburn, both of Ga.

[73] Assignee: The Coca-Cola Company, Atlanta, Ga.

[21] Appl. No.: 260,572

[22] Filed: Jun. 16, 1994

Related U.S. Application Data

[63] Continuation-in-part of Ser. No. 189,828, Feb. 1, 1994.

[51] Int. Cl.[6] ..... F16L 37/28

[52] U.S. Cl. ..... 137/614.2; 137/614.03; 251/149.6

[58] Field of Search ..... 137/614.2, 614.03, 614.05, 137/614.01, 614.02, 614.04; 251/149.1, 149.6, 149.7; 220/288

[56] References Cited

U.S. PATENT DOCUMENTS

| | | | |
|---|---|---|---|
| 4,445,539 | 5/1984 | Credle . | |
| 4,986,304 | 1/1991 | Vanderjagt | 137/614.2 X |
| 5,110,040 | 5/1992 | Kalberer et al. | 220/288 X |
| 5,255,713 | 10/1993 | Scholle et al. . | |

*Primary Examiner*—Martin P. Schwadron
*Assistant Examiner*—Kevin L. Lee
*Attorney, Agent, or Firm*—Thomas R. Boston

[57] ABSTRACT

A bag valve coupling member for a soft drink syrup bag-in-box container having a back-flow preventing one-way valve therein, preferably in addition to the standard self-sealing poppet valve that is biased closed and that is opened when a hose connector coupling member is attached to the bag valve coupling member. The one-way valve prevents back-filling (reuse) of the bag and syrup substitution.

10 Claims, 8 Drawing Sheets

BACK-FLOW PREVENTING BAG VALVE FOR BAG-IN-BOX CONTAINER

CROSS-REFERENCE TO RELATED APPLICATION

This is a continuation-in-part of copending U.S. patent application Ser. No. 08/189,828, filed Feb. 1, 1994, and having the same title and inventors as the present case.

BACKGROUND OF THE INVENTION

This invention relates to bag valve coupling members for the collapsible bags of bag-in-box containers such as are used for soft drink syrups, and in particular to a back-flow preventing valve therefor.

Bag valve coupling members (known as bag valves) for bag-in-box containers are well-known, as shown, for example, in U.S. Pat. No. 4,445,539. Although these containers are intended for single use only, empties of such bags have been back-filled through the bag valve and hose connector, under possibly unsanitary conditions, with the syrup of third parties and re-sold (or palmed off) to unsuspecting purchasers as the original product.

SUMMARY OF THE INVENTION

A bag valve coupling member for a bag of a bag-in-box container including, preferably in addition to the standard self-sealing poppet valve which is caused to open when a hose connector is connected to the bag valve coupling member, a one-way valve which prevents back-filling of the bag through the bag valve coupling member. In the preferred embodiment, the one-way valve is a floating washer or ring for providing a good seal against a pair of circular ridges on the valve seat.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
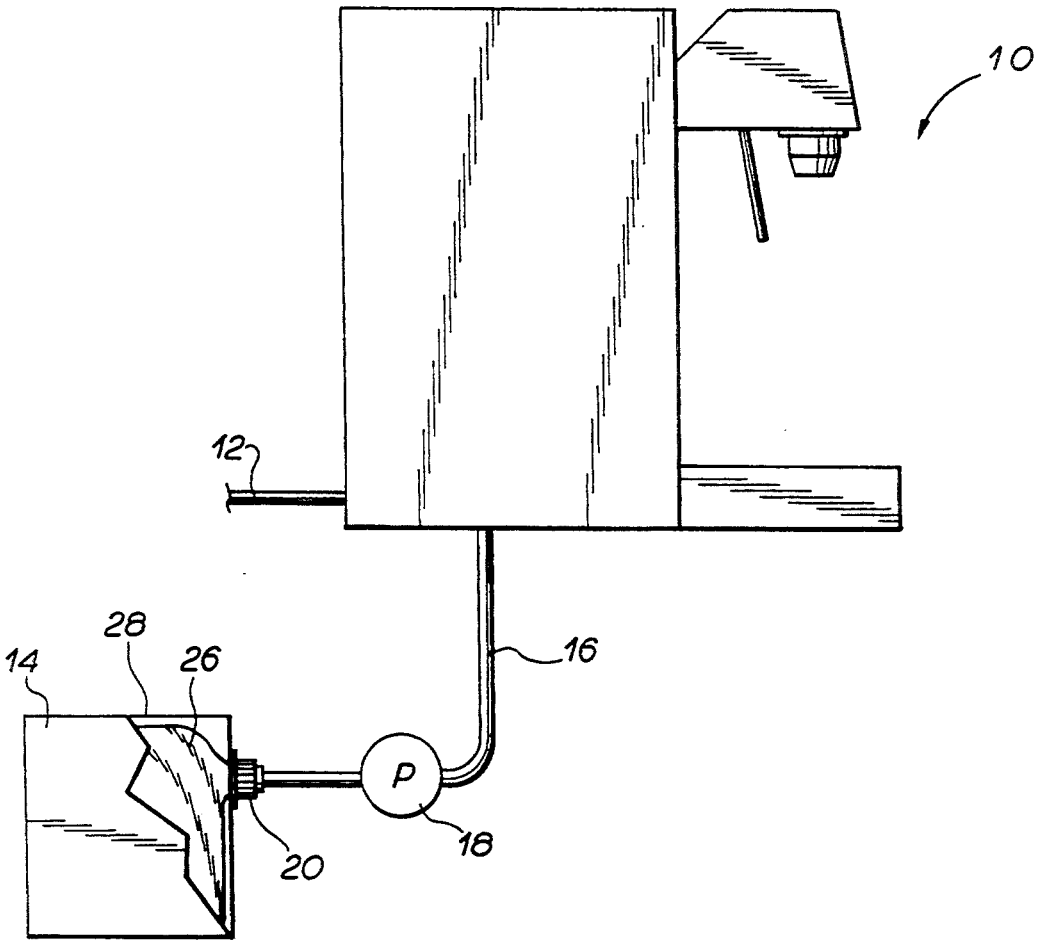
FIG. 1 is a diagrammatic view showing a postmix beverage dispenser connected to a bag-in-box container of syrup.

With reference now to the drawings, FIG. 1 shows a postmix soft drink dispenser 10 connected to a water line 12 and to a bag-in-box syrup container 14 by a syrup line 16 having a pump 18 connected therein. The syrup line 16 has a hose connector 20 (with its own self-sealing valve-see FIG. 3) that matingly connects to a bag valve coupling member 22 (FIGS. 2–5), which member 22 is snap connected into a spout 24 (FIGS. 4 and 5) sealed to a collapsible bag 26 located in a box 28.

FIGS. 2–5 show a bag valve coupling member 22 of the present invention having a back-flow preventing one-way valve 30.

The coupling member 22 includes a housing 32, a poppet valve 40, a spring 46 and a spring retainer 61 that snaps into the housing 32. These parts are old and well-known as shown, for example, in U.S. Pat. No. 4,445,539. The present invention concerns the addition thereto of the washer or ring-shaped one-way valve 30.

The housing 32 is a hollow cylindrical, molded plastic housing having an inner (or proximal) end 34 and an outer (or distal) end 36 and having a liquid passageway 38 therethrough for dispensing liquid out of the bag 26 in the direction from the inner to the outer end (hereby defined as the dispensing liquid flow).

Figure 2:
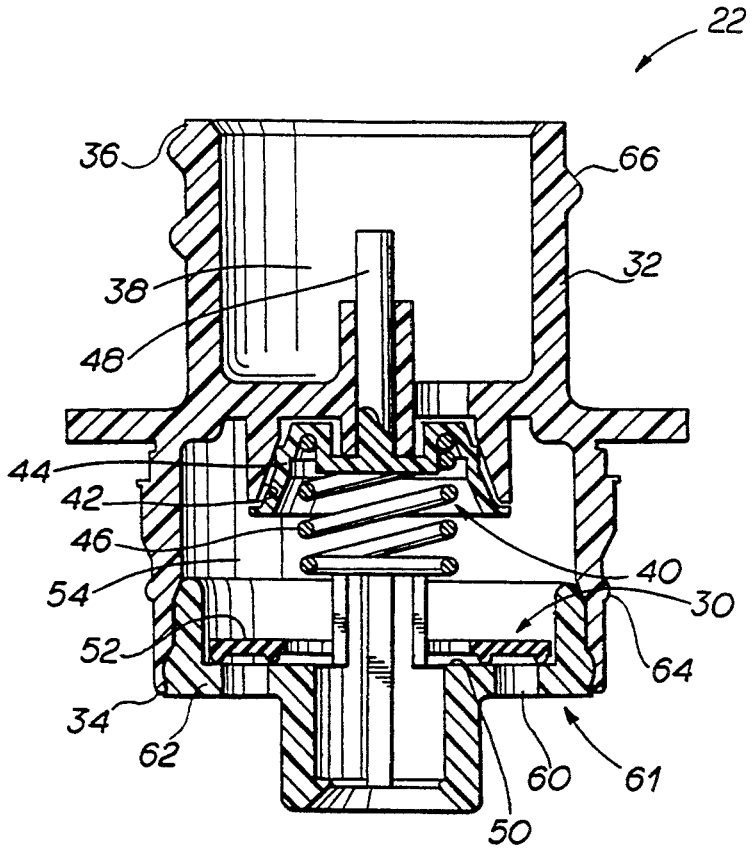
FIG. 2 is a cross-sectional view through one embodiment of a bag valve of this invention.
Figure 3:
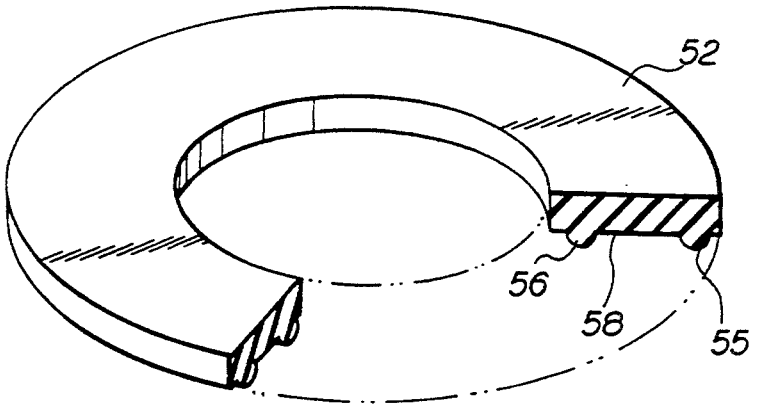
FIG. 3 is a partly cross-sectional perspective view of the ring-shaped valve member 52.
Figure 4:
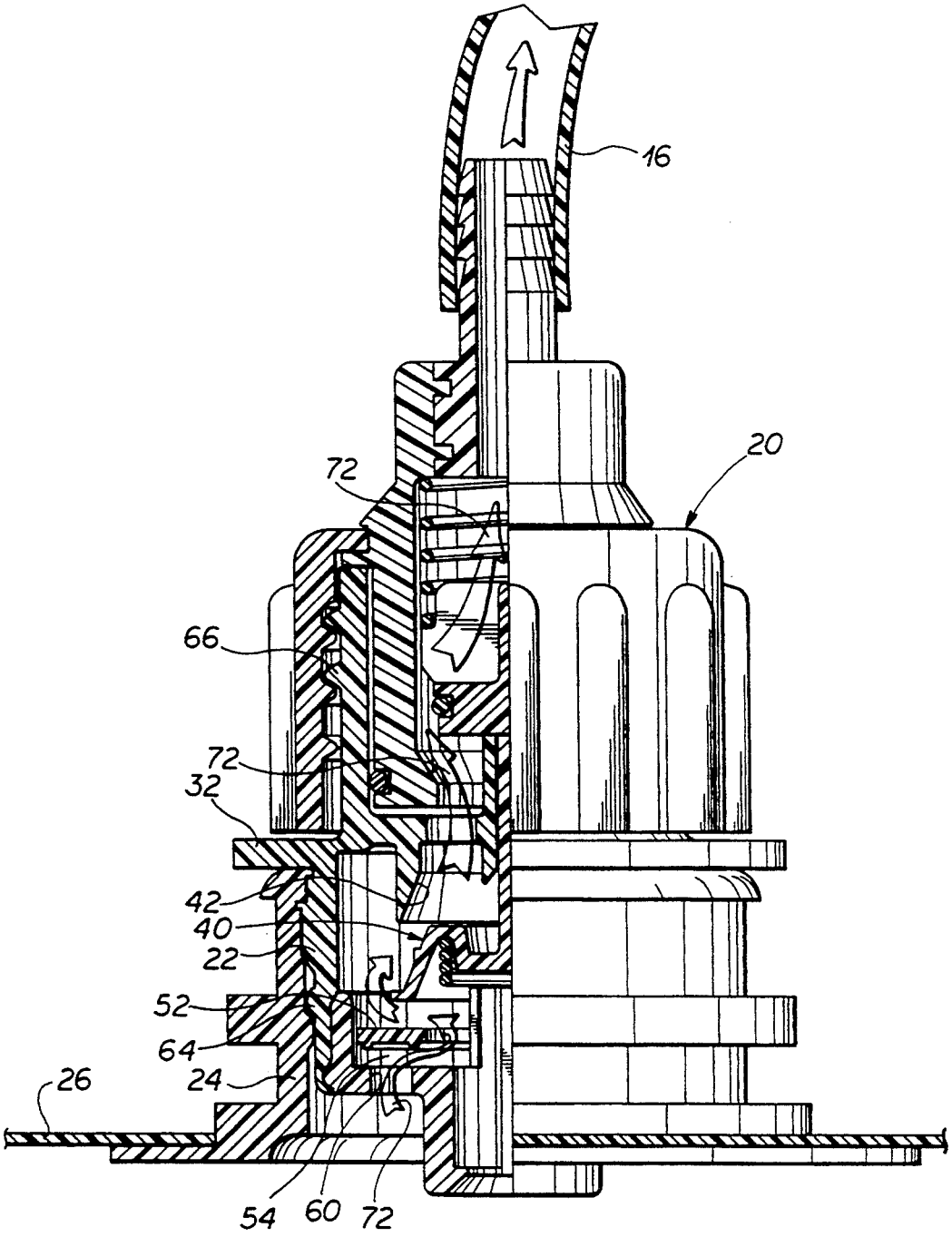
FIG. 4 is a cross-sectional view through the bag valve of this invention shown snapped into a spout of a bag and connected to a hose connector.
Figure 5:
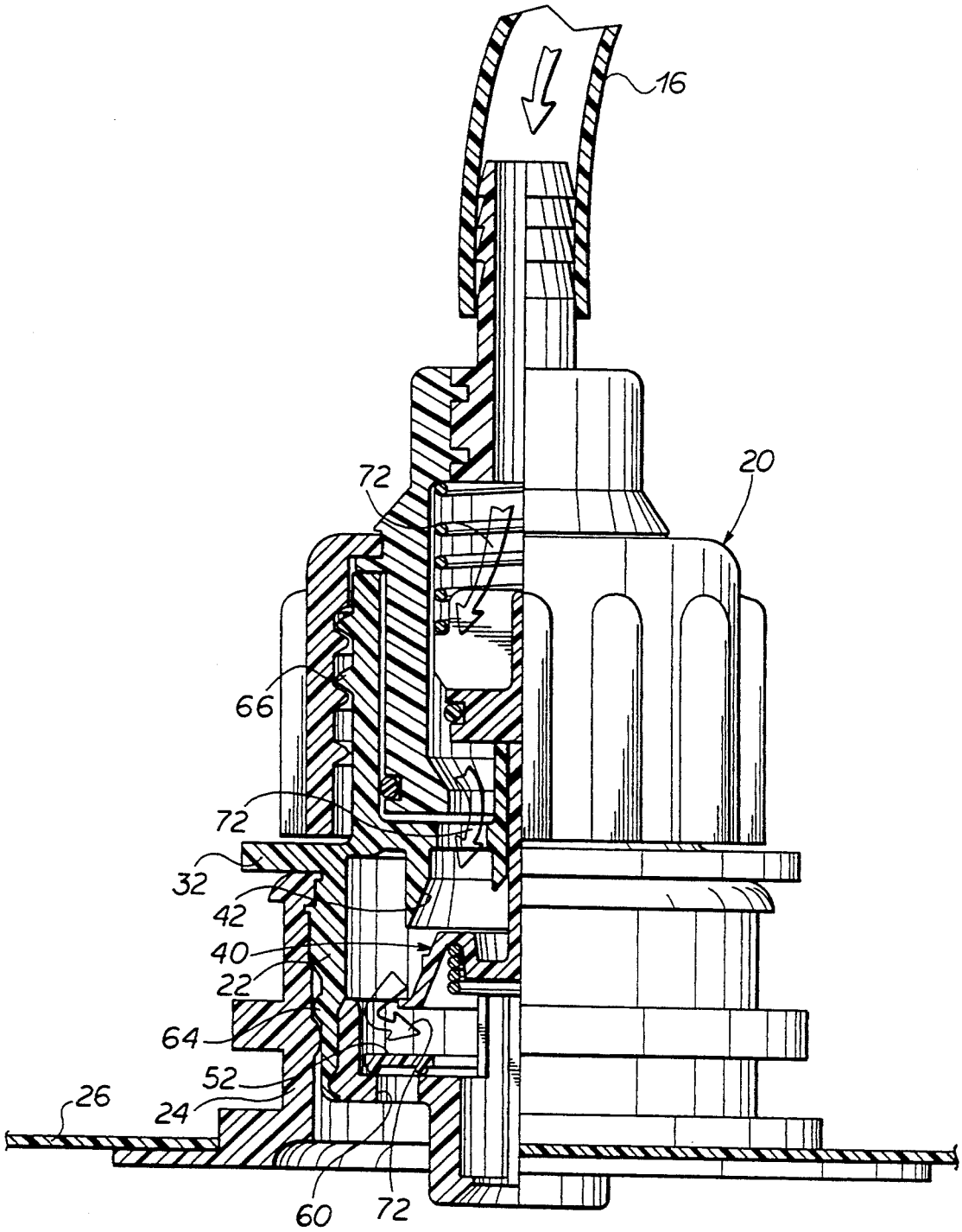
FIG. 5 is a cross-sectional view as in FIG. 3 but showing how the one-way valve prevents back-filling.

The coupling member 22 includes the first, self-sealing poppet valve 40 having a closed position shown in FIG. 2 and an open position shown in FIGS. 4 and 5 and disposed in the passageway 38. The poppet valve 40 includes a valve seat 42, a valve member 44, the biasing spring 46 urging the valve member 44 to its closed position shown in FIG. 2, and a movable valve actuating stem 48 connected to the valve member 44 and extending toward the outer end of the housing, for causing the poppet valve to move to its open position (FIGS. 4 and 5) when the hose connector 20 is connected to the bag valve coupling member.

According to the present invention, the bag valve coupling member 22 is also provided with a second valve, namely the back-flow (back-fill) preventing one-way valve 30. The preferred one-way valve 30 includes a valve seat 50 on the inner surface of the spring retainer 61 and a movable valve member 52 in the shape of a washer or ring. This second valve member 52 is freely floating in a one-way valve chamber 54, such that the valve member 52 is caused to move toward and into sealing contact with the second valve seat 50 by any reverse liquid flow (hereby defined as flow through the passageway 38 in the direction from the outer to the inner end of the housing) through the passageway 38, resulting in closing of the passageway. The valve member 52 is movable away from and out of contact with the second valve seat 50 by dispensing liquid flow through the passageway, thus permitting and not interfering with such flow therethrough. In its open position, there is ample room around the member 52 for liquid flow.

The second valve member 52 (FIG. 3) includes a pair of circular sealing ridges 55 and 56 on the lower surface 58 thereof facing the valve seat 50. These ridges 55 and 56 hit and seal against the valve seat 50 inside of and outside of, respectively, the area of a plurality of equally spaced-apart circular openings 60 in an end wall 62 of the spring retainer 61. The reason for these ridges is to avoid possible poor sealing contact of the valve member 52 itself against the valve seat 50, caused by any nonflatness or small protrusion on either of the contacting surfaces.

It is noted that the housing 32 has means 64 on its outside surface for snap connecting the bag valve coupling member into the spout 24, and also means 66 for connecting it to the hose connector 20. These means 64 and 66 are well-known, as shown in U.S. Pat. No. 4,445,539.

FIGS. 4 and 5 show the bag valve coupling member 22 connected to a standard hose connector 20, such as shown in U.S. Pat. No. 4,445,539 and which need not, therefore, be described in detail here. The hose connector 20 includes its own shut-off valve 70 that is caused to open, along with the poppet valve 40, when the hose connector is attached to the bag valve coupling member 22. The hose connector pushes down on the actuating stem 48 opening the poppet valve 40. FIG. 4 shows, by the arrows 72, dispensing liquid flow out of the bag 26 and shows the one-way valve 30 in an open position. FIG. 5 shows the one-way valve 30 closed and the arrows 74 show an unsuccessful attempt at reverse flow, that is, an attempt to fill an empty bag 26 through the bag valve coupling member 22 and the hose connector 20. The hose connector is connected to the bag valve coupling member, during attempted back-filling, to open the poppet valve 40. However, the one-way valve 30 prevents such re-filling.

Figure 6:
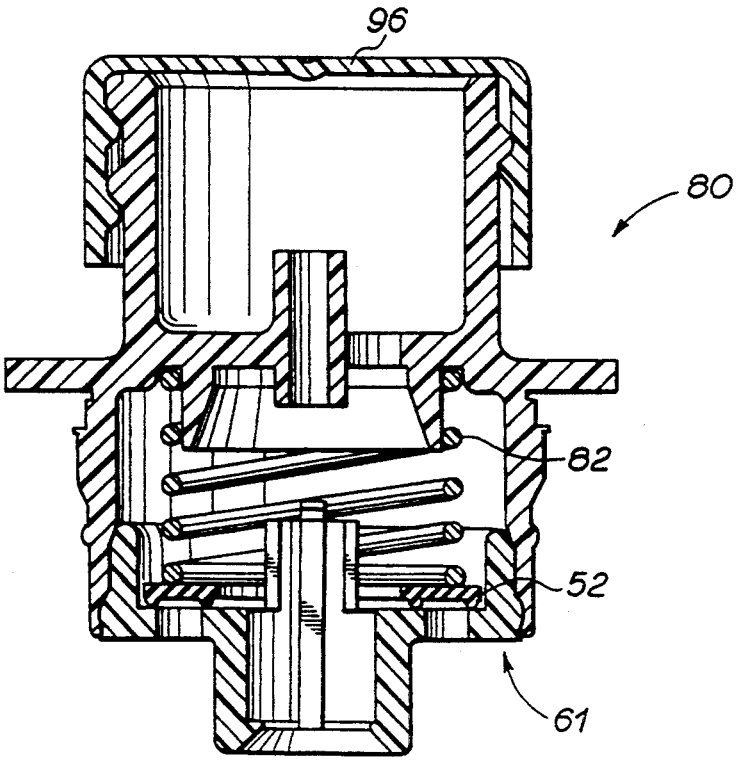
FIG. 6 is a cross-sectional view through another embodiment of a bag valve of this invention.

FIG. 6 shows another embodiment of a bag valve coupling member 80 similar to member 22 of FIG. 2, except that in member 80, the poppet valve 40 and spring 46 are omitted and a spring 82 is added biasing the valve member 52 down to its closed position. The valve member 52 will keep liquid from leaking out of the bag 26 and the spring has a strength such that it will allow the valve member 52 to open when the pump 18 is energized, to dispense liquid from the bag. The valve member 52 will prevent back-filling, as in coupling member 22.

Figure 7:
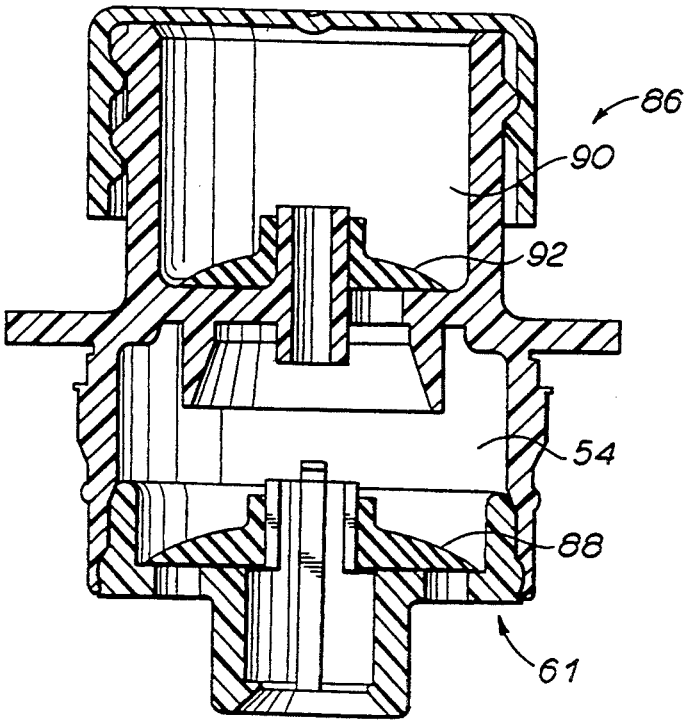
FIG. 7 is a cross-sectional view through still another embodiment of a bag valve of this invention.

FIG. 7 shows still another embodiment of the present invention of a bag valve coupling member 86 similar to member 22 of FIG. 2, except that the poppet valve 40, the spring 46, and the valve member 52 are omitted, and an umbrella valve 88 is added in the chamber 54 to prevent leakage and back-filling while allowing dispensing. In addition, another umbrella valve 92 can be added in the upper chamber 90 to perform the same functions. Preferably both are used; however, either one can be omitted. If only one of the two umbrella valves is to be used, preferably it is the lower one 88 because the upper one 92 can be manually removed by one trying to re-fill the bag.

Figure 8:
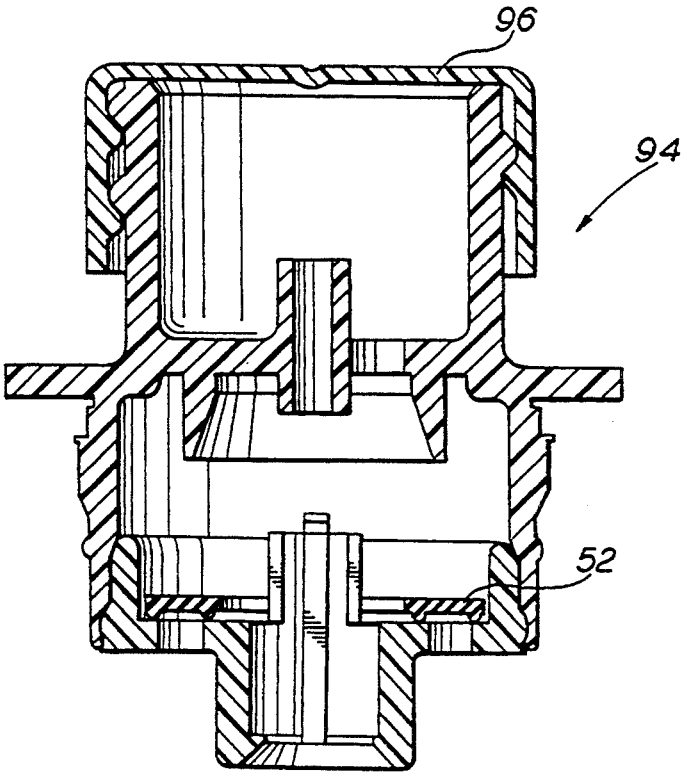
FIG. 8 is a cross-sectional view through another embodiment of a bag valve of this invention.

FIG. 8 shows another embodiment of a bag valve coupling member 94 similar to member 22 of FIG. 2, except that the poppet valve 40 and spring 46 are omitted. The dust cap 96 will keep liquid from leaking out of the bag, and the valve member 52 will prevent back-filling.

Figure 9:
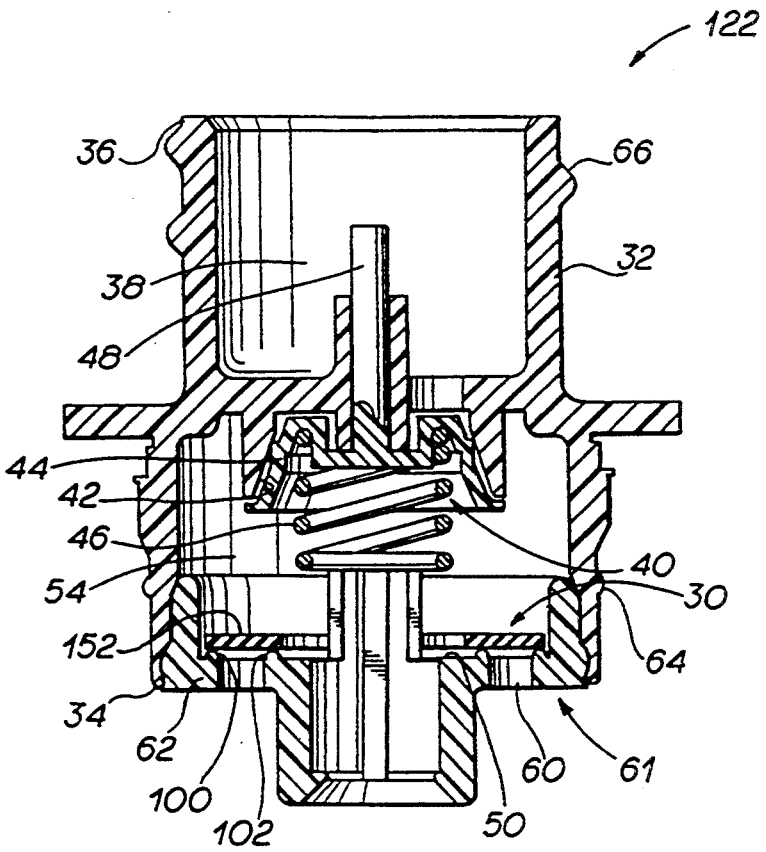
FIG. 9 is a cross-sectional view through a preferred embodiment of the bag valve of this invention.
Figure 10:
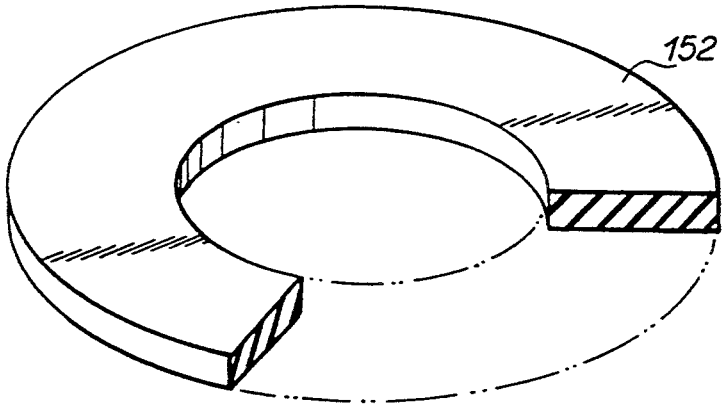
FIG. 10 is a partly cross-sectional, perspective view of the ring-shaped valve member 152 used in FIG. 9.

FIGS. 9 and 10 show another, and the presently preferred, embodiment of a bag valve coupling member 122 of the present invention having a back-flow preventing one-way valve 30. The coupling member 122 is identical to the coupling member 22 of FIGS. 2–5 except that the two circular sealing ridges 55 and 56 on the valve member 52 are omitted and replaced by two circular sealing ridges 100 and 102 on the upper surface of the end wall 62 of the spring retainer 61.

While the preferred embodiment of this invention has been described above in detail, it is to be understood that variations and modifications can be made therein without departing from the spirit and scope of the present invention. For example, other forms and arrangements and locations and types of valves can be used for the one-way valve.

What is claimed is:

1. A bag valve coupling member for a collapsible bag of a bag-in-box container comprising:

(a) a housing having an inner end and an outer end and having a liquid passageway extending therethrough for dispensing liquid flow therethrough in the direction from said inner to said outer end:

(b) a first self-sealing valve having closed and open positions and being disposed in said passageway and including a first valve seat, a first valve member movable into and out of sealing contact with said first valve seat biasing means for biasing said first valve member into sealing contact with said first valve seat, and a movable actuating stem connected to said valve member and extending toward said outer end of said housing for causing said first valve to move to its open position when said stem is caused to move;

(c) a back-flow preventing one-way valve disposed in said passageway for preventing reverse liquid flow through said passageway in the direction from said outer end to said inner end, said one-way valve including a second valve seat and a second valve member being movable toward and into sealing contact with said second valve seat by reverse liquid flow through said passageway closings aid passageway, and being movable away from and out of contact with said second valve seat by dispensing liquid flow through said passageway, opening said passageway; and (d) wherein said housing is cylindrical and said inner end of said housing includes a flat, circular wall perpendicular to the axis of said passageway, said wall including a plurality of equally spaced-apart circular openings in a circular array, and said second valve member being ring-shaped.

2. The coupling member as recited in claim 1 wherein said one-way valve is located between said first valve and said inner end of said housing.

3. The coupling member as recited in claim 1 wherein said second valve seat includes, on its inner surface facing said second valve member, a pair of radially spaced-apart circular ridges, one located radially inside and one located radially outside of said circular array of openings, said ridges providing sealing contact against said second valve member.

4. The coupling member as recited in claim I including a one-way valve chamber located between said first valve and said inner end of said housing, said one-way valve being located in said chamber, said first valve member moving into said chamber and toward said second valve member when moving out of contact with said first valve seat, and said second valve member moving into said chamber and toward said first valve member when moving away from said second valve seat.

5. The coupling member as recited in claim 1 wherein said housing is cylindrical and includes means on its outside surface for connecting said housing to a bag spout.

6. The coupling member as recited in claim 5 wherein said housing also includes means on its outside surface for connecting said housing to a hose connector.

7. The coupling member as recited in claim 6 including a hose connector coupled to said housing, said hose connector including means for contacting and actuating said stem to move said first valve to its open position.

8. The coupling member as recited in claim 1 including a flexible, collapsible bag having a bag spout defining a liquid opening into said bag, and wherein said bag valve coupling member is inserted into and connected to said spout.

9. The coupling member as recited in claim 1 including a spring biasing said one-way second valve into sealing contact with said valve seat to close said passageway.

10. The coupling member as recited in claim 1 including a dust cap connected to said housing on said outer end in liquid sealing relationship to said housing.

* * * * *

UNITED STATES PATENT AND TRADEMARK OFFICE

CERTIFICATE OF CORRECTION

PATENT NO. : 5,445,186

DATED : August 29, 1995

INVENTOR(S) : Richter, et al.

It is certified that error appears in the above-identified patent and that said Letters Patent is hereby corrected as shown below:

Column 4, Claim 1, line 25, delete "closings aid" and insert --closing said-- therefor;

Column 4, Claim 6, line 1, delete "5" and insert --1-- therefor;

Column 6, Claim 9, line 2, delete "second";

Column 6, Claim 9, line 3, insert --second-- before "valve".

Signed and Sealed this

Twentieth Day of February, 1996

*Attest:*

*Attesting Officer*

Bruce Lehman

BRUCE LEHMAN

*Commissioner of Patents and Trademarks*